US007569010B2

(12) United States Patent
Seyffert

(10) Patent No.: US 7,569,010 B2
(45) Date of Patent: Aug. 4, 2009

(54) APPARATUS AND METHOD FOR OPERATING A FOLDING MACHINE FOR A WEB-FED PRINTING PRESS

(75) Inventor: Ulrich Seyffert, Syrau (DE)

(73) Assignee: MAN Roland Druckmaschinen AG, Augsburg (DE)

( * ) Notice: Subject to any disclaimer, the term of this patent is extended or adjusted under 35 U.S.C. 154(b) by 0 days.

(21) Appl. No.: 11/861,648

(22) Filed: Sep. 26, 2007

(65) Prior Publication Data

US 2008/0058190 A1 Mar. 6, 2008

Related U.S. Application Data

(62) Division of application No. 11/335,266, filed on Jan. 19, 2006.

(30) Foreign Application Priority Data

Jan. 20, 2005 (DE) ..... 10 2005 002 683

(51) Int. Cl.
*B31B 1/16* (2006.01)

(52) U.S. Cl. ..... 493/344

(58) Field of Classification Search ..... 493/340, 493/344, 352, 356–357, 444, 424, 405, 359, 493/363, 365, 370
See application file for complete search history.

(56) References Cited

U.S. PATENT DOCUMENTS

| | | | | |
|---|---|---|---|---|
| 2,026,443 | A | 12/1935 | Tomlin | |
| 4,211,396 | A | 7/1980 | Michalik et al. | |
| 5,527,256 | A | 6/1996 | Vauchelle et al. | |
| 5,568,767 | A | 10/1996 | Jackson | |
| 5,692,440 | A | 12/1997 | Hillebrand | |
| 5,983,764 | A | 11/1999 | Hillebrand | |
| 6,360,640 | B1 * | 3/2002 | Cote | 83/287 |
| 2002/0185022 | A1 | 12/2002 | Stieler et al. | |

FOREIGN PATENT DOCUMENTS

| | | |
|---|---|---|
| DE | 671 790 | 2/1939 |
| DE | 43 16 352 A1 | 11/1994 |
| DE | 195 25 169 C2 | 9/1996 |
| DE | 195 18 650 C1 | 10/1996 |
| DE | 199 08 120 A1 | 8/2000 |
| EP | 0 364 864 A2 | 4/1990 |
| GB | 2 291 409 A | 1/1996 |

* cited by examiner

*Primary Examiner*—Christopher Harmon
(74) *Attorney, Agent, or Firm*—Crowell & Moring LLP

(57) ABSTRACT

An apparatus and method for operating a folding machine for a web-fed printing press is disclosed. The folding machine includes a cutting blade cylinder operable with a folding blade cylinder and a folding jaw cylinder. A drive is connected to the cutting blade cylinder. The drive is operable in a non-uniform manner in a collecting mode of the folding machine to supply a first and a second exemplar of different sheet lengths and is operable in a uniform manner in a non-collecting mode of the folding machine.

18 Claims, 2 Drawing Sheets

APPARATUS AND METHOD FOR OPERATING A FOLDING MACHINE FOR A WEB-FED PRINTING PRESS

This application claims the priority of German Patent Document No. 10 2005 002 683.4, filed Jan. 20, 2005, the disclosure of which is expressly incorporated by reference herein.

BACKGROUND AND SUMMARY OF THE INVENTION

The invention relates to a folding machine for a web-fed printing press.

Folding machines for web-fed printing presses have a cutting blade cylinder, a folding blade cylinder and a folding jaw cylinder, whereby exemplars can be cut off from a web substrate with the help of the cutting blade cylinder. The exemplars cut off from the substrate are held by the folding blade cylinder and conveyed further in the direction of the folding jaw cylinder. Due to folding blades integrated into the folding blade cylinder, the exemplars can be inserted into folding jaws in the folding jaw cylinder, forming a fold. The folding jaw cylinder then conveys the exemplars for further processing.

Folding machines that can be operated in a so-called collecting mode are known as the state of the art. In collecting mode, two exemplars are collected and/or brought to an overlapping position on the folding blade cylinder, whereby an exemplar that has been cut from the substrate and is already being held against the folding blade cylinder is guided past the cutting point again and combined with a second cut exemplar on the folding blade cylinder. To prevent trimming, it is necessary here for the exemplars having only slightly differentiable sheet lengths to be separated alternately from the substrate. Thus, the exemplar separated first forms a so-called internal liner sheet after forming the fold; it has a slightly smaller sheet length than the second exemplar that is separated subsequently and is brought to overlapping with the insertion sheet on the folding blade cylinder, forming a so-called outer cover sheet.

German Patent Document No. 671 790 discloses a folding machine having a cutting blade cylinder, a folding blade cylinder and a folding jaw cylinder which can be operated in the collecting mode described above. To implement the separation of exemplars having slightly different sheet lengths, it is proposed according to this state of the art that two cutting blades or only a single cutting blade shall be assigned to the cutting blade cylinder, whereby the cutting blade or each cutting blade cooperates with the cutting strips assigned to the folding blade cylinder, and whereby the cutting strips and/or the cutting blade or each cutting blade is/are moved back and forth rhythmically. In German Patent Document No. 671 790 the alternating separation of exemplars with slightly different sheet lengths is implemented by the rhythmic movement of the cutting strips and cutting blades back-and-forth. The folding machine according to German Patent Document No. 671 790 has the disadvantage that additional drive units are required for the rhythmic movement of the cutting strips and cutting blades, causing a complex and therefore expensive design of the folding machine.

Against this background, the present invention is based on the problem of creating a novel folding machine for a web-fed printing press.

According to this invention, a separate drive is assigned to the cutting blade cylinder, whereby in collecting mode of the folding machine, the drive is operated non-uniformly to provide exemplars of different sheet lengths to be collected and is operated uniformly in non-collecting mode of the folding machine.

In collecting mode to separate an exemplar having a shortened sheet length before executing the separation step, the angular velocity of the cutting blade cylinder is preferably increased on the average, whereas for separating an exemplar having a lengthened sheet length, the angular velocity of the cutting blade cylinder is reduced on the average before executing the separating cut, whereby the angular velocity of the cutting blade cylinder is constant in execution of the particular separating cut and the circumferential speed is equal to the web speed.

Preferred refinements of this invention are derived from the following description. Exemplary embodiments of the invention are explained in greater detail with reference to the drawings without being restricted to this.

DETAILED DESCRIPTION OF THE DRAWINGS

The present invention is described in greater detail below with reference to FIGS. 1 through 4.

Figure 1:
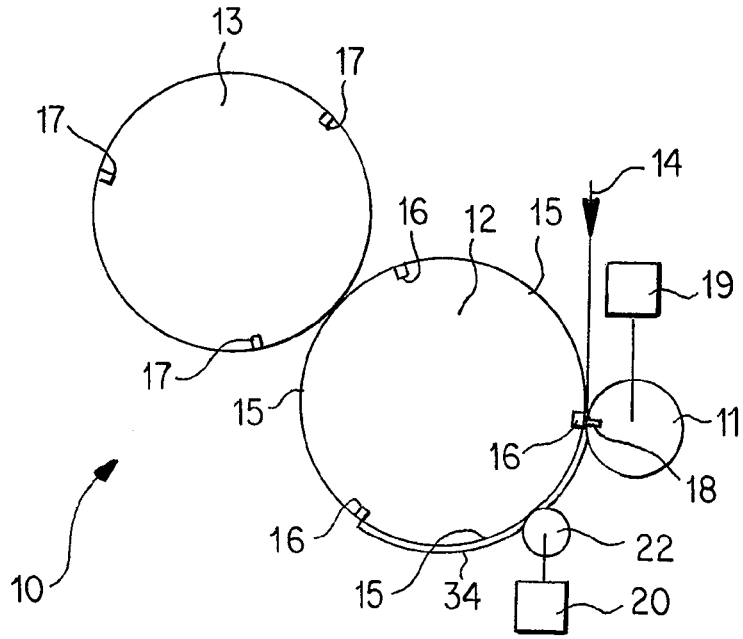
FIG. 1 shows a schematic diagram of the inventive folding machine for a web-fed printing press comprising a cutting blade cylinder, a folding blade cylinder and a folding jaw cylinder.

FIG. 1 shows a folding machine 10 for a web-fed printing press having a cutting blade cylinder 11, a folding blade cylinder 12 and a folding jaw cylinder 13. The cutting blade cylinder 11 and the folding jaw cylinder are co-rotating and contra-rotating with the folding blade cylinder 12. A substrate 14 is moved, i.e., guided between the cutting blade cylinder 11, the folding blade cylinder 12 and the folding jaw cylinder 13. Exemplars can be cut off from the substrate 14 with the help of the cutting blade cylinder 11.

The folding blade cylinder 12 preferably comprises three folding blades 15, three cutting strips 16 and three puncture devices (not shown). The three folding blades 15 are positioned with an equal distribution on the circumference of the folding blade cylinder 12, so they are spaced a distance apart with an angle of 120°. The three cutting strips 16 are also each positioned so they are equally distributed on the circumference of the folding blade cylinder 12 and spaced a distance apart at an angle of 120°, with one folding blade 15 being arranged between two cutting strips 16. The three puncture devices (not shown) are also positioned so they are equally distributed on the circumference of the folding blade cylinder 12 and are spaced a distance apart from one another with an angle of 120°, whereby the puncture devices (not shown) are positioned near the cutting strips 16. The folding jaw cylinder 13 preferably has three folding jaws 17 which are also positioned so that they are equally distributed on the circumference of the folding jaw cylinder 13 and are spaced a distance apart from one another at an angle of 120°.

To provide a fold on an exemplar separated from the substrate 14 with the help of the cutting blade cylinder 11 during so-called non-collecting mode of the folding machine 10 of the cutting blade cylinder 11, the folding blade cylinder 12 and the folding jaw cylinder 13 cooperate, so that when an exemplar is separated from the substrate 14 with the help of the cutting blade cylinder 11, the exemplar thus separated is held at the beginning of the page by a puncture device (not shown) and is conveyed further with the revolution of the folding blade cylinder 12. In this way, the separated exemplar is moved into a relative position between the folding blade cylinder 12 and the folding jaw cylinder 13, the position being defined for the formation of the fold, in which case when this relative position is reached, a folding blade 15 of the folding blade cylinder 12 presses the exemplar in the folding area between the opened folding jaw 17 of the folding jaw cylinder 13, whereas the puncture device (not shown) releases the exemplar. The exemplar thus held by the folding jaw cylinder 13 is then moved further with the revolution of the folding jaw cylinder 13 and is released by the folding jaw cylinder for further processing at a suitable position.

If the folding machine 10 shown in FIG. 1 is operated in the collecting mode, then an exemplar separated from the substrate 14 with the help of the cutting blade cylinder 11 and held on the folding blade cylinder 12 is again passed by the cutting blade cylinder 11 and combined with a second exemplar separated from the substrate 14. It is important here that exemplars with slightly different sheet lengths are alternately separated from the substrate to prevent trimming. The present invention now provides a folding machine which implements the alternate separation of exemplars having slightly different sheet lengths for collecting mode of same in a particularly simple manner.

In the sense of the present invention, it is provided that the cutting blade cylinder 11 shall have only a single cutting blade 18 mounted in a stationary mount on the cutting blade cylinder 11, whereby the cutting blade 18 cooperates with one of the cutting strips 16 on the folding blade cylinder 12 in the execution of a separating cut. To ensure mutual separation of exemplars having slightly different sheet lengths in the case of the cutting blade cylinder 11 with only a single stationary cutting blade 18, it is also provided in the sense of the present invention that a separate drive 19 be provided for the cutting blade cylinder 11, whereby the drive 19 is operated non-uniformly in the collecting mode of the folding machine 10 to provide exemplars having slightly different sheet lengths, whereas in non-collecting mode of the folding machine 10 the drive 19 can be operated uniformly. The drive 19 is preferably designed as a pulsating a.c. drive.

Figure 3:
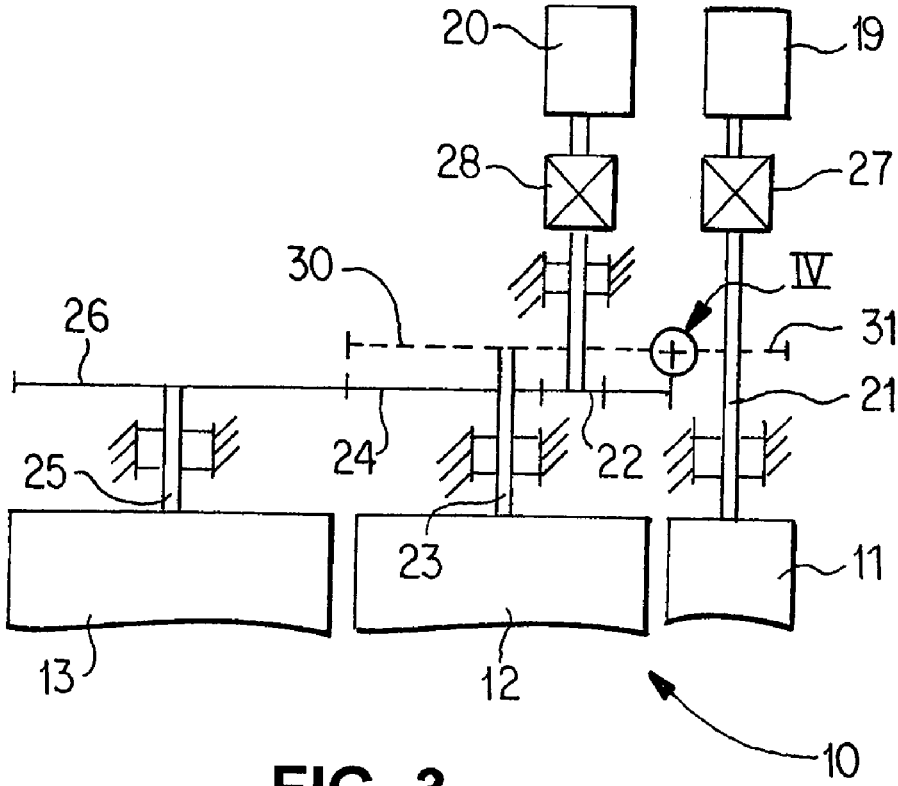
FIG. 3 shows another diagram of the inventive folding machine for a web-fed printing press.

As FIG. 1 indicates, a drive 20 is provided for the folding blade cylinder 12, whereby the drive 20 not only drives the folding blade cylinder 12 but also drives the folding jaw cylinder 13. As indicated by FIG. 3 in particular, the drive 19 assigned to the cutting blade cylinder 11 drives the shaft 21 of the cutting blade cylinder 11, whereas the drive 20 assigned to the folding blade cylinder 12 drives a gear wheel 24 mounted on a shaft 23 of the folding blade cylinder 12 via a gear wheel 22, whereby the gear wheel 24 mounted on the shaft 23 of the folding blade cylinder 12 cooperates with a gear wheel 26 mounted on a shaft 25 of the folding jaw cylinder 13 and thereby also ensures a drive for the folding jaw cylinder 13. As FIG. 3 also shows, the drive 19 assigned to the cutting blade cylinder 11 is connected to the shaft 21 via a coupling 27 while the drive 20 for the folding blade cylinder 12 and the folding jaw cylinder 13 can be introduced via a coupling 28.

For alternating separation of exemplars with slightly different sheet lengths, the drive 19 assigned to the cutting blade cylinder 11 is operated via a control unit (not shown) such that the drive 19 drives the cutting blade cylinder 11 at a constant angular velocity during the execution of a cut, whereas the angular velocity of the cutting blade cylinder 11 is increased on the average before execution of the cut for cutting off an exemplar with a shorter sheet length and the angular velocity of the cutting blade cylinder 11 is reduced on the average via the drive 19 before executing the cut for cutting off an exemplar having a longer sheet length.

Figure 2:
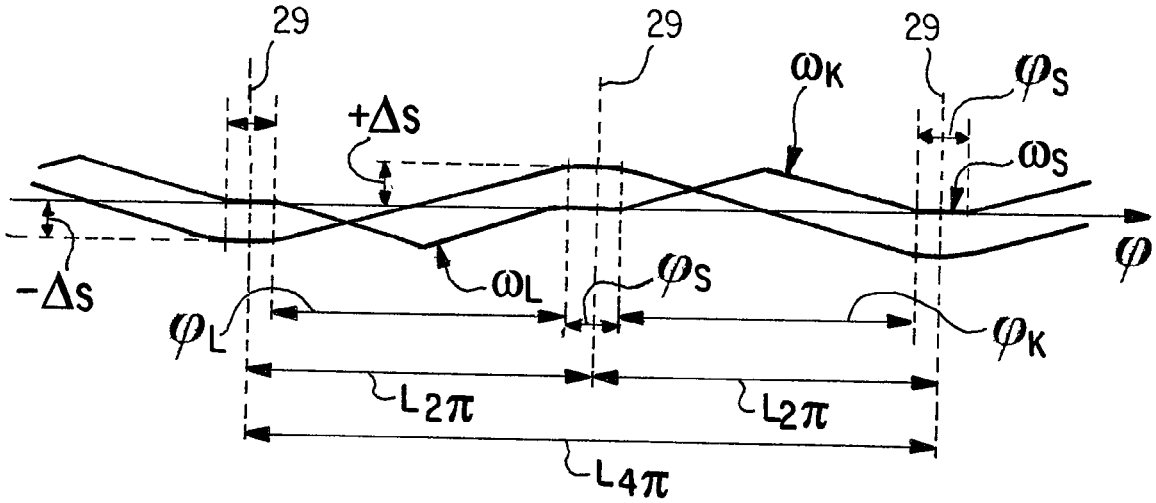
FIG. 2 shows a schematic diagram to illustrate the functioning of the drive for the cutting blade cylinder of the inventive folding machine.

FIG. 2 visualizes the changing angular velocity $\omega$ and the relative change in the path S of the cutting blade cylinder 11 and/or the drive 19 in a highly schematic form, with the angle of rotation $\phi$ of the cutting blade cylinder 11 plotted on the horizontal axis. After each full revolution of the cutting blade cylinder 11, the cutting blade 18 of the same executes a cut, where the dotted lines 29 running vertically visualize the execution of a cut. As FIG. 2 shows, the angular velocity $\omega_S$ of the cutting blade cylinder 11 remains constant during the execution of a cut as well as shortly before and after execution of the same. If an exemplar with a longer sheet length is to be cut off subsequently after executing a cut with which an exemplar with a shortened sheet length, for example, was cut off from the substrate 14, then starting from the constant angular velocity $\omega_S$, the angular velocity of the cutting blade cylinder 11 is reduced. However, if an exemplar 34 with a shortened sheet length is to be cut off, the angular velocity of the cutting blade cylinder is increased. However, there is always a constant angular velocity in executing the cut per se, where the circumferential velocity corresponds to the web velocity.

FIG. 2 shows the reduced angular velocity for cutting off an exemplar with a longer sheet length characterized by $\omega_L$, whereas increasing the angular velocity for cutting off an exemplar with a shortened sheet length is represented by $\omega_K$. A complete revolution of the cutting blade cylinder 11 is shown on a scale of a single sheet in FIG. 2 and thus amounts to $2\pi$, whereas two full revolutions for alternating cutting of an exemplar with a longer sheet length followed by one with a shorter sheet length is represented in FIG. 2 by $4\pi$. The angles traversed during the revolution of the cutting blade cylinder 11 with angular velocities $\omega_L$, $\omega_S$ and $\omega_K$ are represented by $\phi_L$, $\phi_S$ and $\phi_K$ in FIG. 2. The path deviation S of the cutting blade 18 implementable by the drive described above for alternately separating an exemplar with a shortened sheet length and an exemplar with a longer sheet length is also depicted in FIG. 2, where the path deviation is in a range between 0.1 mm and 5 mm, in particular, especially 1 mm.

Figure 4:
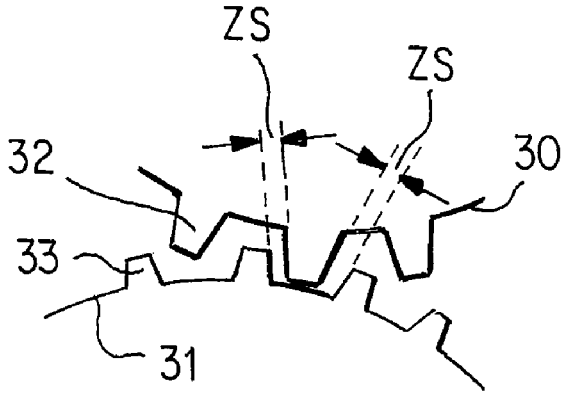
FIG. 4 shows an enlarged diagram of detail IV of FIG. 3.

Another special feature of the inventive folding machine is that in the event of failure of one of the drives 19 or 20, the drive remaining in operation can drive the cylinder(s) which was/were previously being driven by the failed drive. For example, FIG. 3 shows with dotted lines that in addition to the gear wheel 24 on the shaft 23 of the folding blade cylinder 12, another gear wheel 30 is mounted coaxially on the shaft. Likewise, a gear wheel 31 is mounted on the shaft 21 of the cutting blade cylinder 11. As FIG. 4 shows, these gear wheels 30 and 31 cooperate so that when both drives 19 and 20 are functional, a tooth play ZS develops between the teeth 32 and 33 of these gear wheels 30 and 31. Owing to this tooth play ZS, the flanks of teeth 32 and 33 are then not in contact with one another so there is no active engagement between the two gear wheels 30 and 31. Owing to the tooth play ZS, the two gear wheels 30 and 31 are thus separated from one another when the two drives 19 and 20 are in operation. However, if one of the drives fails, e.g., the drive 20 for the folding blade cylinder 12 and the folding jaw cylinder 13, then the folding mechanism can be separated without any further damage.

In this connection it should be pointed out that the tooth play ZS between the gear wheels 30 and 31 is of such an extent that the path deviation S of the cutting blade 18 of the cutting blade cylinder 11 can be compensated so that the flanks of the teeth 32 and 33 do not come into contact as a result of the path deviation S of the cutting blade 18 in the collecting mode with two active drives 19 and 20. Since a tooth play ZS between the gear wheels 30 and 31 in both collecting mode and non-collecting mode of the folding machine 10 when there are two active drives 19 and 20, then there is no longer a transfer of forces between the gear wheels 30 and 31. Only in the event of failure of one of the two drives 19 and 20 is a transfer of force between the two gear wheels 30 and 31 established, eliminating the tooth play ZS and ensuring problem-free stoppage of the folding mechanism without any subsequent damage.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

LIST OF REFERENCE NUMERALS

10 folding machine
11 cutting blade cylinder
12 folding blade cylinder
13 folding jaw cylinder
14 substrate
15 folding blade
16 cutting strip
17 folding jaw
18 cutting blade
19 drive
20 drive
21 shaft
22 gear wheel
23 shaft
24 gear wheel
25 shaft
26 gear wheel
27 coupling
28 coupling
29 cut line
30 gear wheel
31 gear wheel
32 tooth
33 tooth
34 exemplar

What is claimed is:

1. A folding machine for a web-fed printing press, having a cutting blade cylinder (11), a folding blade cylinder (12) and a folding jaw cylinder (13), wherein exemplars (34) are cut off from a web of a substrate (14) by the cutting blade cylinder (11), the cut exemplars (34) held by the folding blade cylinder (12) and conveyed further in a direction of the folding jaw cylinder (13), and in a collecting mode of the folding machine, several exemplars (34) are collectable on the folding blade cylinder (12) such that at least two exemplars (34) of different sheet lengths cut off by the cutting blade cylinder (11) are superimposed one above the other on the folding blade cylinder (12) and sent to the folding jaw cylinder (13) as collected exemplars (34), wherein the cutting blade cylinder (11) has at least one cutting blade (18), and wherein:

a) a separate drive (19) is assigned to the cutting blade cylinder (11); and b) a control unit assigned to the drive (19) of the cutting blade cylinder (11) controls the drive (19) at a non-uniform or a uniform setpoint angular velocity as a function of whether the folding machine is being operated in the collecting mode or a non-collecting mode, such that:

b1) the cutting blade cylinder (11) is operated with uniform angular velocity in the non-collecting mode of the folding machine; and b2) an angular velocity ($\omega_K$) of the cutting blade cylinder (11) is increased in the collecting mode before executing a cut for cutting off an exemplar having a shortened sheet length, and wherein for cutting off an exemplar with a longer sheet length an angular velocity ($\omega_L$) of the cutting blade cylinder (11) is reduced before execution of a cut, and wherein for executing a particular cut, an angular velocity ($\omega_S$) of the cutting blade cylinder (11) is constant and a circumferential angular velocity is equal to a web velocity.

2. The folding machine according to claim 1, wherein the drive (19) is a pulsating a.c. drive.

3. The folding machine according to claim 1, wherein the cutting blade (18) of the cutting blade cylinder (11) is mounted in a stationary mount on the cutting blade cylinder (11).

4. The folding machine according to claim 1, wherein the folding blade cylinder (12) has several folding blades (15) and several puncture devices, wherein the folding blades are mounted in an equal distribution in a circumferential direction on the folding blade cylinder (12) such that a defined angular distance is maintained between neighboring folding blades and wherein the puncture devices are mounted in an equal distribution over the circumferential direction on the folding blade cylinder (12) such that a defined angular distance is maintained between neighboring puncture devices.

5. The folding machine according to claim 1, wherein the folding blade cylinder (12) has several cutting strips (16) which cooperate with the cutting blade (18) of the cutting blade cylinder (11) during cutting, wherein the cutting strips are mounted in an equal distribution in a circumferential direction on the folding blade cylinder (12) such that a defined angular distance is maintained between neighboring cutting strips.

6. The folding machine according to claim 5, wherein the cutting strips (16) of the folding blade cylinder (12) are stationary.

7. The folding machine according to claim 1, wherein the drive (19) assigned to the cutting blade cylinder (11) drives a shaft (21) of the cutting blade cylinder (11), and wherein the folding blade cylinder (12) and the folding jaw cylinder (13) have a common drive (20) wherein gear wheels (24, 26) which are driven by the common drive (20) and engage with one another are mounted on a shaft (23) of the folding blade cylinder (12) and on a shaft (25) of the folding jaw cylinder (13).

8. The folding machine according to claim 7, wherein another gear wheel (30) is mounted on the shaft (23) of the folding blade cylinder (12) coaxially with the gear wheel (24) mounted thereon, the another gear wheel engaging with the gear wheel (26) mounted on the shaft (25) of the folding jaw cylinder (13), wherein the another gear wheel (30) engages with a gear wheel (31) mounted on the shaft (21) of the cutting blade cylinder (11) such that there is a tooth play (ZS) between the same.

9. The folding machine according to claim 8, wherein when there is a failure of the drive (19) assigned to the cutting blade cylinder (11) the drive is uncoupleable via a clutch (27) from the shaft (21) of the cutting blade cylinder (11), and wherein, when the tooth play (ZS) is eliminated, the drive (20) of the folding blade cylinder (12) and the folding jaw cylinder (13) drives the cutting blade cylinder (11).

10. The folding machine according to claim 8, wherein when there is a failure of the drive (20) assigned to the folding blade cylinder (12) and to the folding jaw cylinder (13) the drive is uncoupleable via a clutch (28), and wherein, when the tooth play (ZS) is eliminated, the drive (19) of the cutting blade cylinder (11) drives the folding blade cylinder (12) and the folding jaw cylinder (13).

11. A folding machine for a web-fed printing press, having a cutting blade cylinder (11), a folding blade cylinder (12) and a folding jaw cylinder (13), wherein exemplars (34) are cut off from a web of a substrate (14) by the cutting blade cylinder (11), the cut exemplars (34) held by the folding blade cylinder (12) and conveyed further in a direction of the folding jaw cylinder (13), and in a collecting mode of the folding machine, several exemplars (34) are collectable on the folding blade cylinder (12) such that at least two exemplars (34) of different sheet lengths cut off by the cutting blade cylinder (11) are superimposed one above the other on the folding blade cylinder (12) and sent to the folding jaw cylinder (13) as collected exemplars (34), wherein the cutting blade cylinder (11) has at least one cutting blade (18), and wherein:

a) a separate drive (19) is assigned to the cutting blade cylinder (11), which drives a shaft (21) of the cutting blade cylinder (11);

b) a control unit assigned to the drive (19) of the cutting blade cylinder (11) controls the drive (19) at a non-uniform or a uniform setpoint angular velocity as a function of whether the folding machine is being operated in the collecting mode or a non-collecting mode, such that:

b1) the cutting blade cylinder (11) is operated with uniform angular velocity in the non-collecting mode of the folding machine; and b2) an angular velocity (107 $_K$) of the cutting blade cylinder (11) is increased in the collecting mode before executing a cut for cutting off an exemplar having a shortened sheet length, and wherein for cutting off an exemplar with a longer sheet length an angular velocity (107 $_L$) of the cutting blade cylinder (11) is reduced before execution of a cut, and wherein for executing a particular cut, an angular velocity (107 $_S$) of the cutting blade cylinder (11) is constant and a circumferential angular velocity is equal to a web velocity;

whereby a path deviation (S) of the respective cutting blade (18) is realized;

c) the folding blade cylinder (12) and the folding jaw cylinder (13) have a common drive (20), wherein gear wheels (24, 26) which are driven by the common drive (20) and engage with one another are mounted on a shaft (23) of the folding blade cylinder and on a shaft (25) of the folding jaw cylinder; and d) another gear wheel (30) is mounted on the shaft (23) of the folding blade cylinder (12) coaxially with the gear wheel (24) mounted thereon, the another gear wheel engaging with the gear wheel (26) mounted on the shaft (25) of the folding jaw cylinder (13), wherein the another gear wheel (30) engages with a gear wheel (31) mounted on the shaft (21) of the cutting blade cylinder (11) such that there is a tooth play (ZS) between the same, and wherein the tooth play (ZS) is dimensioned such that, despite the path deviation (S) in the collecting mode with both active drives (19, 20), tooth profiles of the gear wheels (30, 31) do not touch.

12. The folding machine according to claim 11, wherein when there is a failure of the drive (19) assigned to the cutting blade cylinder (11) the drive is uncoupleable via a clutch (27) from the shaft (21) of the cutting blade cylinder (11), and wherein, when the tooth play (ZS) is eliminated, the drive (20) of the folding blade cylinder (12) and the folding jaw cylinder (13) drives the cutting blade cylinder (11).

13. The folding machine according to claim 11, wherein when there is a failure of the drive (20) assigned to the folding blade cylinder (12) and to the folding jaw cylinder (13) the drive is uncoupleable via a clutch (28), and wherein, when the tooth play (ZS) is eliminated, the drive (19) of the cutting blade cylinder (11) drives the folding blade cylinder (12) and the folding jaw cylinder (13).

14. The folding machine according to claim 11, wherein the drive (19) is embodied as a pulsating a.c. drive.

15. The folding machine according to claim 11, wherein the cutting blade (18) of the cutting blade cylinder (11) is mounted in a stationary mount on the cutting blade cylinder.

16. The folding machine according to claim 11, wherein the folding blade cylinder (12) has several folding blades (15) and several puncture devices, wherein the folding blades are mounted in an equal distribution in a circumferential direction on the folding blade cylinder (12) such that a defined angular distance is maintained between neighboring folding blades and wherein the puncture devices are mounted in an equal distribution over the circumferential direction on the folding blade cylinder (12) such that a defined angular distance is maintained between neighboring puncture devices.

17. The folding machine according to claim 11, wherein the folding blade cylinder (12) has several cutting strips (16) which cooperate with the cutting blade (18) of the cutting blade cylinder (11) during cutting, wherein the cutting strips are mounted in an equal distribution in a circumferential direction on the folding blade cylinder (12) such that a defined angular distance is maintained between neighboring cutting strips.

18. The folding machine according to claim 17, wherein the cutting strips (16) of the folding blade cylinder (12) are stationary.

* * * * *